US010427409B2

(12) United States Patent
Shindo

(10) Patent No.: US 10,427,409 B2
(45) Date of Patent: Oct. 1, 2019

(54) INKJET PRINTER

(71) Applicant: Brother Kogyo Kabushiki Kaisha, Nagoya-shi, Aichi-ken (JP)

(72) Inventor: Tatsuya Shindo, Nagoya (JP)

(73) Assignee: Brother Kyogo Kabushiki Kaisha, Nagoya-shi, Aichi-ken (JP)

( * ) Notice: Subject to any disclaimer, the term of this patent is extended or adjusted under 35 U.S.C. 154(b) by 2 days.

(21) Appl. No.: 15/652,324

(22) Filed: Jul. 18, 2017

(65) Prior Publication Data

US 2018/0072060 A1 Mar. 15, 2018

(30) Foreign Application Priority Data

Sep. 9, 2016 (JP) ..... 2016-176739

(51) Int. Cl.

*B41J 2/175* (2006.01)
*B41J 2/165* (2006.01)
*B41J 2/195* (2006.01)
*B41J 29/38* (2006.01)

(52) U.S. Cl.

CPC ..... *B41J 2/16517* (2013.01); *B41J 2/16526* (2013.01); *B41J 2/175* (2013.01); *B41J 2/1752* (2013.01); *B41J 2/17509* (2013.01); *B41J 2/17513* (2013.01); *B41J 2/17546* (2013.01); *B41J 2/17553* (2013.01); *B41J 2/17566* (2013.01); *B41J 2/17596* (2013.01); *B41J 2/195* (2013.01); *B41J 29/38* (2013.01); *B41J 2002/16573* (2013.01)

(58) Field of Classification Search

CPC .... B41J 2/16517; B41J 2/17546; B41J 2/195; B41J 2/17596; B41J 2/17566; B41J 2/17553; B41J 29/38; B41J 2/1752; B41J 2/17513; B41J 2/17509; B41J 2/175; B41J 2/16526; B41J 2002/16573

See application file for complete search history.

(56) References Cited

U.S. PATENT DOCUMENTS 8,348,364 B2 * 1/2013 Taga ..... B08B 5/04 347/14
2015/0097882 A1 * 4/2015 Uchiyama ..... B41J 2/165 347/6

FOREIGN PATENT DOCUMENTS

JP 2004358668 A 12/2004
JP 2005169847 A 6/2005
JP 2006-192821 A * 7/2006 ..... B41J 2/18

* cited by examiner

*Primary Examiner* — Yaovi M Ameh
(74) *Attorney, Agent, or Firm* — Banner & Witcoff, Ltd.

(57) ABSTRACT

An inkjet printer includes a head including a nozzle configured to eject pigment ink supplied from a tank during a print operation and during a purge operation and a purge mechanism. A controller configured to determine whether to control the purge mechanism to perform the purge operation for discharging the pigment ink from the nozzle and, when determining to control the purge mechanism to perform the purge operation, determine a remaining amount of the pigment ink remaining in the tank. The controller is configured to determine a discharge amount to be discharged from the nozzle when performing the purge operation based on the remaining amount of the pigment ink remaining in the tank and control the purge mechanism to perform the purge operation based on the discharge amount.

4 Claims, 9 Drawing Sheets

Fig.7A

FOR STANDARD INK CARTRIDGE

| | | REMAINING INK AMOUNT | | |
|---|---|---|---|---|
| | | LARGE | MEDIUM | SMALL |
| TEMPERATURE | HIGH | a | b | c |
| | LOW | d | e | f |

Fig.7B

FOR HIGH-YIELD INK CARTRIDGE

| | | REMAINING INK AMOUNT | | |
|---|---|---|---|---|
| | | LARGE | MEDIUM | SMALL |
| TEMPERATURE | HIGH | A | B | C |
| | LOW | D | E | F |

Fig.9A

FOR STANDARD INK CARTRIDGE

| | | REMAINING INK AMOUNT | | |
|---|---|---|---|---|
| | | LARGE | MEDIUM | SMALL |
| TEMPERATURE | HIGH | u | v | w |
| | LOW | x | y | z |

Fig.9B

FOR HIGH-YIELD INK CARTRIDGE

| | | REMAINING INK AMOUNT | | |
|---|---|---|---|---|
| | | LARGE | MEDIUM | SMALL |
| TEMPERATURE | HIGH | U | V | W |
| | LOW | X | Y | Z |

INKJET PRINTER

CROSS-REFERENCE TO RELATED APPLICATION

This application claims priority from Japanese Patent Application No. 2016-176739 filed on Sep. 9, 2016, the content of which is incorporated herein by reference in its entirety.

FIELD OF DISCLOSURE

The disclosure relates to an inkjet printer.

BACKGROUND

A known inkjet printer includes a print head and a purging mechanism. The print head has nozzles configured to eject ink supplied from a tank. The purging mechanism is configured to forcibly discharge ink from the nozzles. The inkjet printer may use pigment ink in which pigments are suspended or dispersed in a solvent.

The pigment ink has advantages, e.g., excellent color strength, and disadvantages, e.g., pigment settling. The pigments may settle at a bottom or a lower end of the tank during periods of storage or non-use. Such pigment settling may cause a portion of the pigment ink at the bottom of the tank to be locally concentrated or enriched and become viscous. The viscous ink supplied to the print head may clog the nozzles.

One solution to this problem is to discharge the concentrated ink out of the tank by executing a purge operation. For the purge operation, the inkjet printer determines an amount of ink consumed by the print head during a predetermined period of time. When the amount of ink consumed is less than the predetermined amount, the inkjet printer controls the purge mechanism to discharge or purge, through the nozzles, a particular amount of ink that varies depending on the amount of ink consumed. However, the inkjet printer may discharge too much ink during the purge operation.

SUMMARY

One or more aspects of the disclosure provide an inkjet printer configured to perform a purge operation in which an appropriate amount of pigment ink may be discharged according to an amount of ink remaining in a tank.

An inkjet printer according to an aspect of the present invention includes a head including a nozzle configured to eject pigment ink supplied from a tank during a print operation and during a purge operation and a purge mechanism. A controller is configured to determine whether to control the purge mechanism to perform the purge operation for discharging the pigment ink from the nozzle, when determining to control the purge mechanism to perform the purge operation, determine a remaining amount of the pigment ink remaining in the tank. The controller is configured to determine a discharge amount to be discharged from the nozzle when performing the purge operation based on the remaining amount of the pigment ink remaining in the tank; and control the purge mechanism to perform the purge operation based on the discharge amount.

In a further aspect, an inkjet printer includes a head including a nozzle configured to eject pigment ink supplied from a tank, a purge mechanism that is controlled to perform a purge operation on the nozzles, and a timer configured to count a time interval after a print operation or purge operation. A controller is configured to determine whether the time interval exceeds a predetermined time interval and determine an amount of the pigment ink remaining in the tank. The controller is configured to, when the amount of pigment ink remaining in the tank is below a predetermined amount, reset the timer and when the amount of pigmented ink remaining in the tank is above a predetermined amount and determine an amount of pigment ink discharged during the time interval is less than a reference amount. The controller is configured to, when the amount of discharged pigment ink is less than the reference amount, determine an adjustment value, determine a discharge amount to be discharged during a purge operation based on the amount of discharged pigment ink, the reference amount, and the adjustment value; and control the purge mechanism to perform the purge operation based on the discharge amount.

In a further aspect, an inkjet printer includes a head including a nozzle configured to eject pigment ink supplied from a tank, a purge mechanism that is controlled to perform a purge operation on the nozzles and a timer configured to count a time interval after a print operation or purge operation. The controller is configured to determine that the purge operation is to be performed and determine an adjustment value. The controller is configured to determine a discharge amount to be discharged during a purge operation based on the amount of discharged pigment ink, the reference amount, and the adjustment value and control the purge mechanism to perform the purge operation based on the discharge amount.

BRIEF DESCRIPTION OF THE DRAWINGS

FIGS. 7A and 7B depict adjustment value tables.

FIGS. 9A and 9B depict reference amount tables.

DETAILED DESCRIPTION

First Illustrative Embodiment

Figure 1:
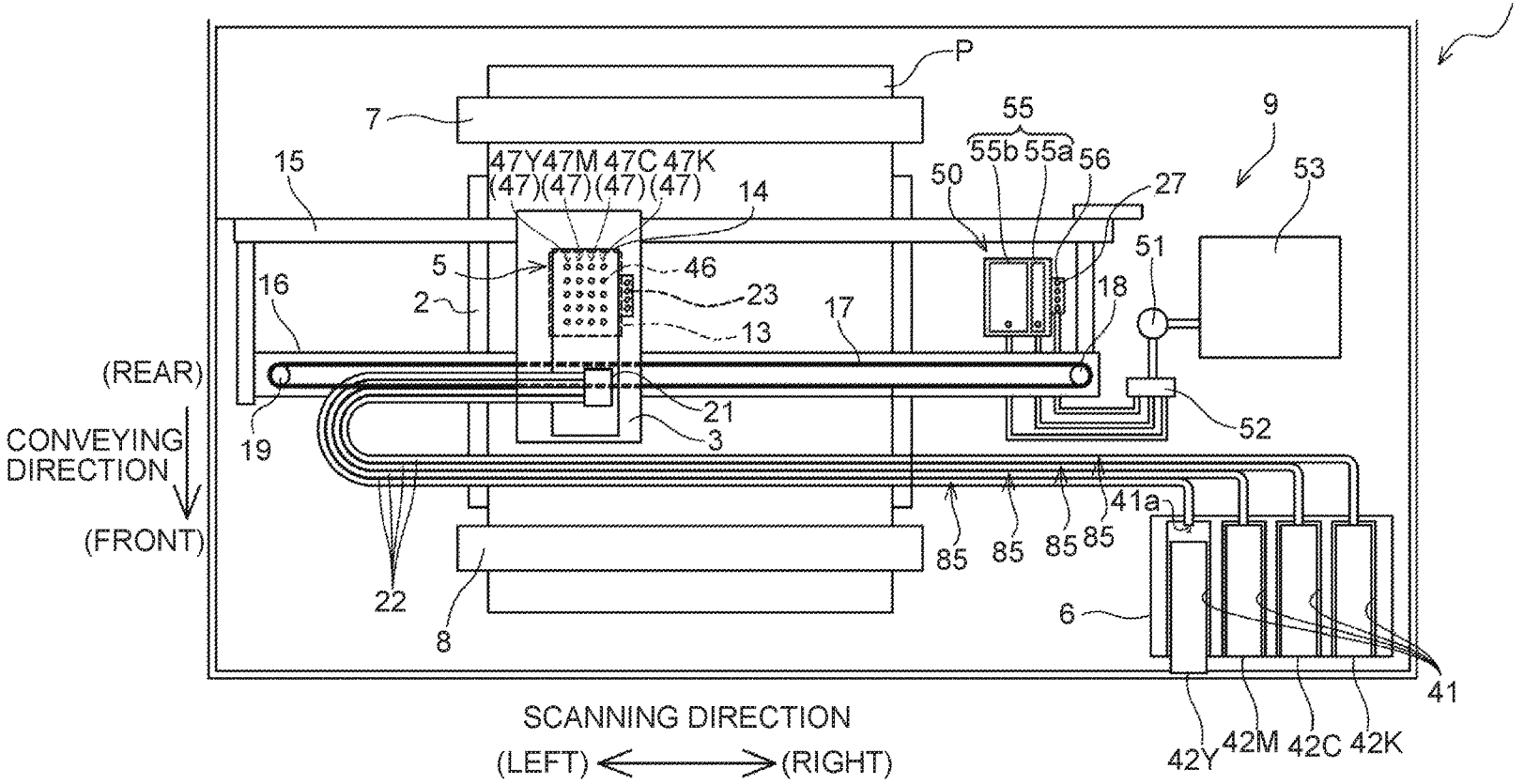
FIG. 1 is a schematic diagram of an inkjet printer in an illustrative embodiment according to one or more aspects of the disclosure.

An inkjet printer 1 in an illustrative embodiment according to one or more aspects of the disclosure will be described with reference to the accompanying drawings. Components of the printer 1 may be described using directional terminology such as "upper/top," "lower/bottom," "front," "rear," "left," "right" etc., as labelled in the drawings. With respect to the page of FIG. 1, near and far sides may be defined as upper and lower sides of the printer 1, respectively. Because the disclosed components can be positioned in a number of different orientations, the directional terminology is used for purposes of illustration and is in no way limiting.

Figure 2:
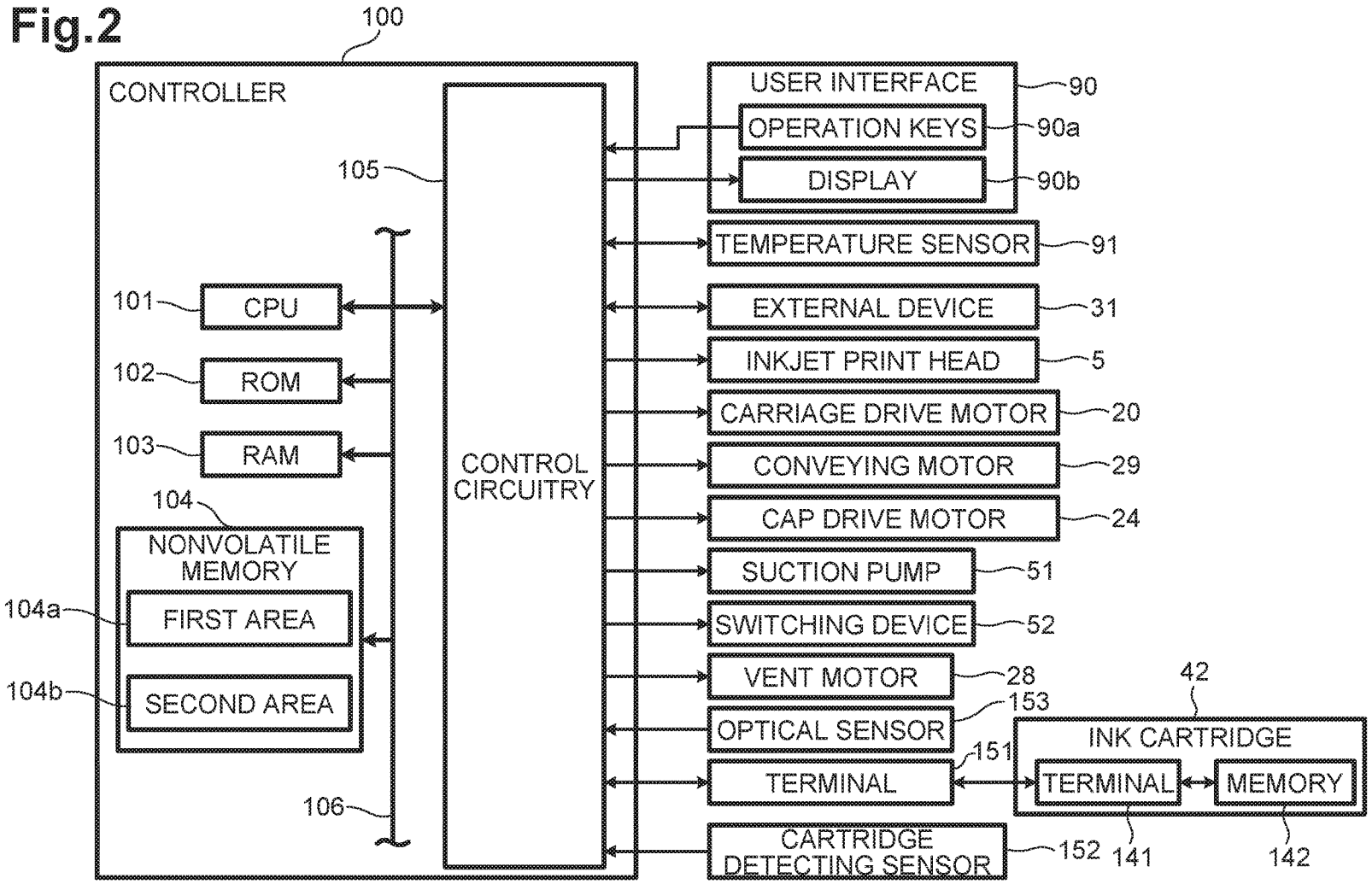
FIG. 2 is a block diagram depicting an electrical configuration of the inkjet printer according to one or more aspects of the disclosure.

As depicted in FIG. 1, the printer 1 includes a platen 2, a carriage 3, an inkjet print head 5 (hereinafter, simply referred to as the "head" 5), a holder 6, a feed roller 7, a discharge roller 8, a maintenance unit 9. As depicted in FIG. 2, the printer 1 further includes a user interface 90, a temperature sensor 91, and a controller 100.

The platen 2 is configured to receive or support a recording medium, e.g., a sheet P, on an upper surface thereof. Above the platen 2, two guide rails 15 and 16 extend parallel to each other in the left-right direction (e.g., a scanning direction).

The carriage 3 is attached to the guide rails 15 and 16. The carriage 3 is configured to move in the scanning direction along the guide rails 15 and 16, in an area facing the platen 2. The carriage 3 has a drive belt 17 attached thereto. The drive belt 17 may be an endless belt wound around opposing pulleys 18 and 19. The pulley 18 is connected to a carriage drive motor 20 (refer to FIG. 2). The carriage drive motor 20 may drive the pulley 18 to move the drive belt 17, thereby reciprocating the carriage 3 on which the head 5 is mounted, in the scanning direction.

Figure 3A:
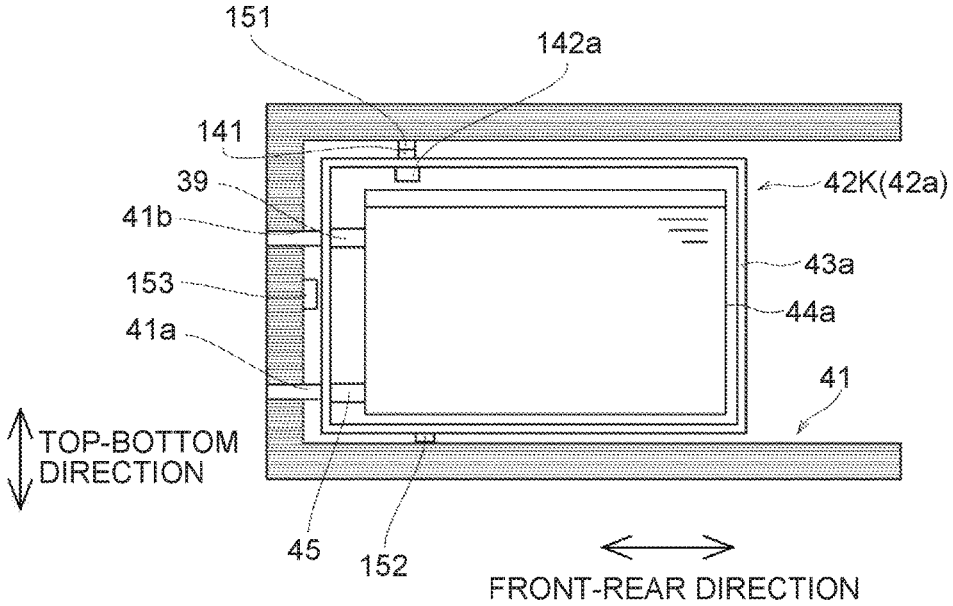
FIG. 3A is a side cross-sectional view of an ink cartridge received in a cartridge receiving portion of the inkjet printer according to one or more aspects of the disclosure.
Figure 3B:
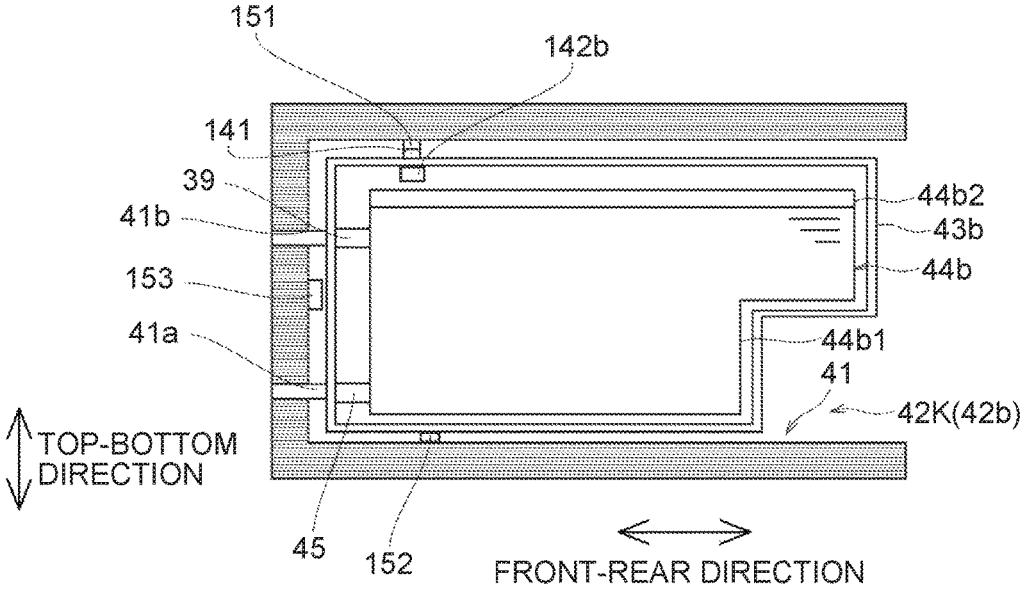
FIG. 3B are a side cross-sectional view of another ink cartridge received in the cartridge receiving portion of the inkjet printer according to one or more aspects of the disclosure.

The holder 6 includes four cartridge receiving portions 41 arranged in the left-right direction. Each of the cartridge receiving portions 41 is configured to removably receive a corresponding one of ink cartridges 42, each containing different one of black, yellow, cyan, and magenta pigment inks. Each ink cartridge 42 may be one of a standard ink cartridge 42*a* and a high-yield ink cartridge 42*b*. The standard ink cartridge 42*a* contains less initial ink than the high-yield ink cartridge 42*b*. Referring to FIGS. 3A and 3B, the cartridge receiving portion 41 is configured to receive the standard ink cartridge 42*a* and the high-yield ink cartridge 42*b* selectively. Hereinafter, the ink cartridges 42 containing black, yellow, cyan, and magenta inks may be referred to as the ink cartridges 42K, 42Y, 42C and 42M, respectively.

In one example, a printer manufacturer may supply a standard black ink cartridge, a high-yield black ink cartridge, and each of standard cyan, standard yellow and standard magenta ink cartridges. In another example, the printer manufacturer may supply both a standard ink cartridge and a high-yield ink cartridge for each of black, cyan, yellow and magenta.

As depicted in FIG. 3A, the standard ink cartridge 42*a* includes a casing 43*a*, an ink chamber 44*a*, a conduit 45, and an air communicating port 39. The casing 43*a* and the ink chamber 44*a*, each have a generally rectangular parallelepiped shape. The ink chamber 44*a* is located inside the casing 43*a* and is configured to store ink therein. The conduit 45 is connected to a lower portion of the ink chamber 44*a*. The air communicating port 39 is connected to a portion of the ink chamber 44*a* above the conduit 45.

The conduit 45 is a part of a fluid passage through which ink stored in the ink chamber 44*a* may flow out of the standard ink cartridge 42*a*. The conduit 45 is connected with a supply tube 41*a* of the cartridge receiving portion 41 when the standard ink cartridge 42*a* is mounted on the cartridge receiving portion 41, thereby establishing a fluid communication between the supply tube 41*a* and the conduit 45.

The air communication portion 39 includes a valve. The valve is configured to open when the smaller ink cartridge 42*a* is mounted on the cartridge receiving portion 41. The open valve may allow the ink chamber 44*a* to communicate with the atmosphere, which is an exterior of the smaller ink cartridge 42*a*, via an air communication passage 41*b* formed in the cartridge receiving portion 41.

The standard ink cartridge 42*a* includes a terminal 141 disposed on an outer surface of the casing 43*a*, and a memory 142*a* disposed on an inner surface of the casing 43*a*. The memory 142*a* is electrically connected to the terminal 141. The memory 142*a* may store quantity data, for example, first quantity data representing a first initial amount of ink contained in the standard ink cartridge 42*a* at the time of shipment.

The cartridge receiving portion 41 also has a terminal 151 configured to electrically connect to the terminal 141 of the standard ink cartridge 42*a* when the standard ink cartridge 42*a* is mounted on the cartridge receiving portion 41. Electrical connection between the terminal 141 of the standard ink cartridge 42*a* and the terminal 151 of the cartridge receiving portion 41 may allow the controller 100 to refer to data stored in the memory 142*a* of the standard ink cartridge 42*a*. The cartridge receiving portion 41 includes a cartridge detecting sensor 152 configured to sense or detect whether the standard ink cartridge 42*a* is mounted on the cartridge receiving portion 41, and an optical sensor 153 configured to detect whether an amount or level of ink remaining in the standard ink cartridge 42*a* is less than a predetermined amount or level (e.g., a near empty level).

Next, the high-yield ink cartridge 42*b* is now described. The high-yield ink cartridge 42*b* has similar configuration to the standard ink cartridge 42*a*, except for a casing and an ink chamber. As depicted in FIG. 3B, the ink cartridge 42*b* includes an ink chamber 44*b*. Each of a lower chamber 44*b*1 and an upper chamber 44*b*2 is a part of the ink chamber 44*b*. The upper chamber 42*b* is located above the lower chamber 44*b*1. The ink chamber 44*b* of the high-yield ink cartridge 42*b* has the same dimension in the top-bottom or vertical direction and the same dimension in the left-right direction as the ink chamber 44*a* of the standard ink cartridge 42*a*. The lower chamber 44*b*1 of the high-yield ink cartridge 42*b* has a generally same dimension in the front-rear direction as the ink chamber 44*a* of the standard ink cartridge 42*a*, while the upper chamber 44*b*2 of the high-yield ink cartridge 42*b* has a dimension in the front-rear direction greater than the ink chamber 44*a* of the standard ink cartridge 42*a*. This configuration allows the ink chamber 44*b* to store much ink than the ink chamber 44*a*. The ink chamber 44*a* and the ink chamber 44*b* (the lower chamber 44*b*1), each have the generally same bottom area. The high-yield ink cartridge 42*b* includes a casing 43*b* having a shape corresponding to the shape of the ink chamber 44*b*.

The high-yield ink cartridge 42*b* includes a memory 142*b* disposed on an inner surface of the casing 43*b*. The memory 142*b* is electrically connected to the terminal 141. The memory 142*b* may store quantity data, for example, second quantity data representing a second initial amount of ink contained in the high-yield ink cartridge 42*b* at the time of shipment. The second initial amount of ink is greater than the first initial amount of ink. The first quantity data is different from the second quantity data. The first quantity data may be a first numeral (e.g., 10) that represents the first initial amount (10 cc) of ink. The second quantity data may be a second numeral (e.g., 20) that represents the second initial amount (20 cc) of ink. The first quantity data may also be a first identification character (e.g., "A") that represents the standard ink cartridge 42*a*. The second quantity data may also be a second identification character (e.g., "B") that represents the high-yield cartridge 42*b*.

The memory 142*a* of the standard ink cartridge 42*a* and the memory 142*b* of the high-yield ink cartridge 42*b* may be collectively referred to as the memory 142.

Referring back to FIG. 1, the head 5 is configured to be removably mounted to the carriage 3. The head 5 includes a head body 13 and a sub-tank 14. The sub-tank 14 is provided with a tube joint 21 at an upper surface thereof. The tube joint 21 is configured to receive one ends of each of four flexible tubes 22. An opposite end of each of the flexible tubes 22 is connected to the supply tube 41*a* of a corresponding one of the four cartridge receiving portions 41 of the holder 6. Ink in the ink cartridges 42 mounted to the cartridge receiving portions 41 is supplied to the sub-tank 14, via the flexible tubes 22.

The head body 13 is attached at a low part of the sub-tank 14. The head body 13 has a plurality of nozzles 46 formed in a lower surface thereof, and head fluid passages 48 (refer to FIG. 5) that fluidally communicate with the nozzles 46. The head body 13 is configured to receive ink from the sub-tank 14 and eject the ink through the nozzles 46. The nozzles 46 are arranged in, for example, four, nozzle arrays 47 along the left-right direction. The nozzle arrays 47 include a nozzle array 47Y; a nozzle array 47M; a nozzle array 47C; and the nozzle array 47K. Each of the four nozzle arrays 47 includes a particular number of nozzles 46, each nozzle 46 being configured to eject ink of a corresponding color.

Figure 4:
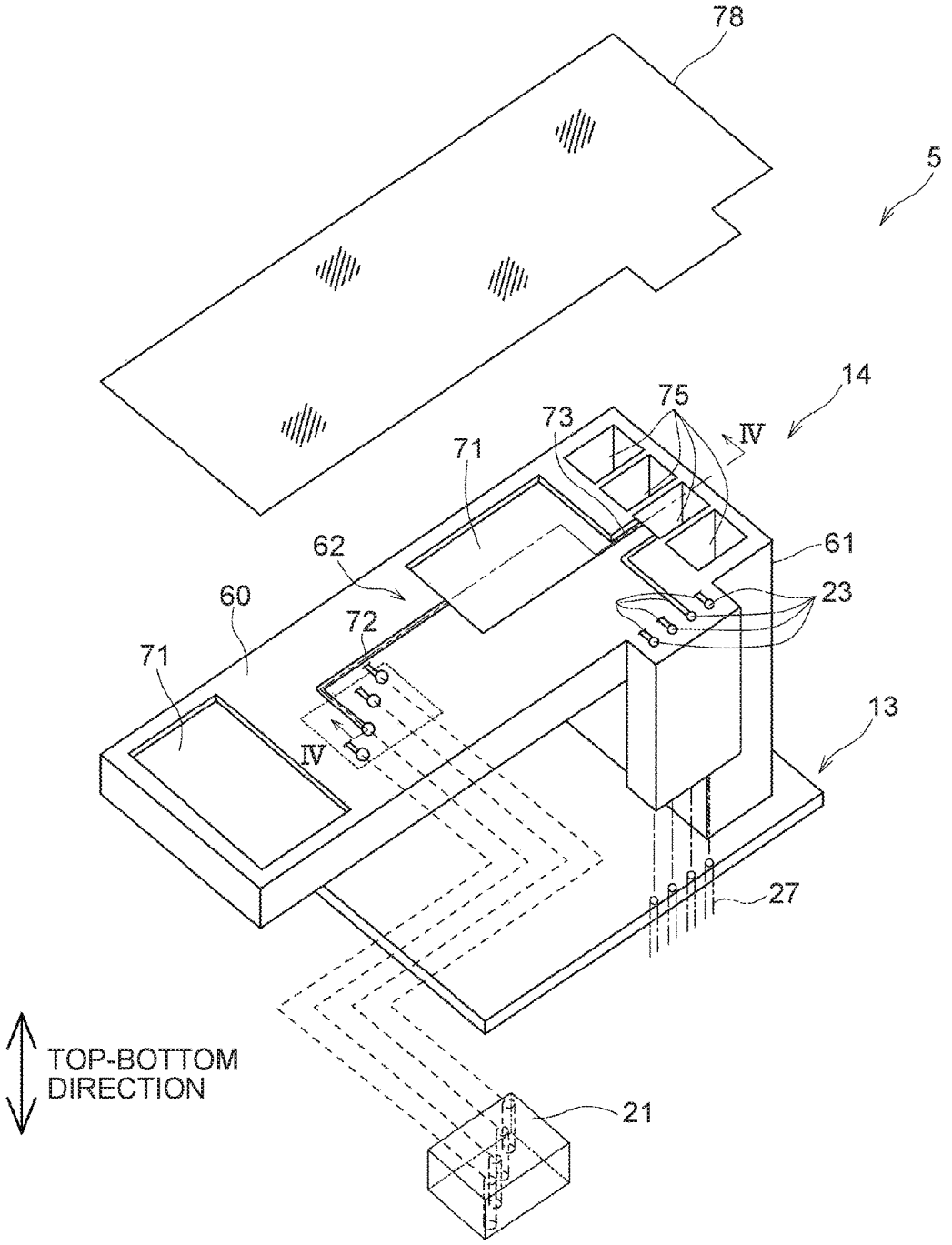
FIG. 4 is a perspective view of an inkjet head of the inkjet printer according to one or more aspects of the disclosure.
Figure 5:
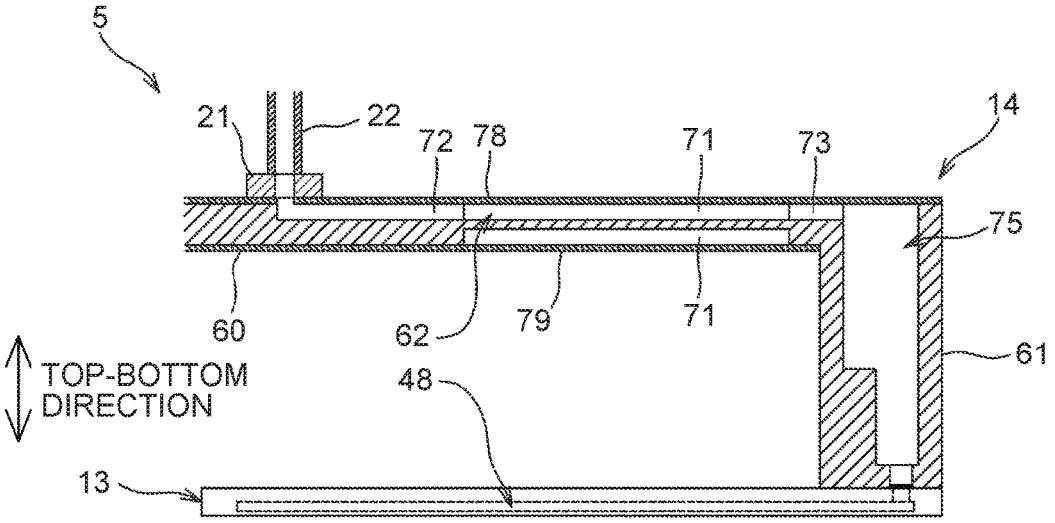
FIG. 5 is a cross-sectional view of the inkjet head taken along a line IV-IV in FIG. 4, according to one or more aspects of the disclosure.

The sub-tank 14 is formed with synthetic resin. As depicted in FIGS. 4 and 5, the sub-tank 14 includes a plate-shaped main body 60 and a connecting portion 61. The main body 60 extends horizontally. The connecting portion 61 extends vertically from an end portion of the main body 60 and connects to the head body 13. The sub-tank 14 has four supply passages 62. Each ink of four colors flows toward the head body 13 through each supply passage 62, respectively. In FIG. 4, one of the supply passages 62 is illustrated in detail while other three supply passages 62 are not.

The tube joint 21 is attached to an upper surface of the main body 60. The tube joint 21 is configured to receive the four flexible tubes 22. Ink contained in the ink cartridges 42 may be supplied to the supply passages 62 via the flexible tubes 22 connected to the tube joint 21.

Each of the supply passages 62 has a damper chamber 71 formed in the main body 60, and a connecting passage 75 formed in the connecting portion 61. The damper chamber 71 is a recess into a surface of the main body 60. Four damper chambers 71 are provided in correspondence with four ink colors. Two of the damper chambers 71 are provided on an upper surface of the main body 60 while other two of the damper chambers 71 are provided on a lower surface of the main body 60. As depicted in FIG. 5, an upper damper chamber 71 in the upper surface of the main body 60 is open upwardly, and a lower damper chamber 71 in the lower surface of the main body 60 is open downwardly. The tube joint 21 fluidly communicates to the upper damper chamber 71 via a groove-like passage 72 formed in the upper surface of the main body 60. The upper damper chamber 71 fluidly communicates to the connecting passage 75, via a passage 73 formed in the upper surface of the main body 60. Although not illustrated in FIG. 4, the tube joint 21 fluidly communicates to the lower damper chamber 71 via the passage 72 and the lower damper chamber 71 fluidly communicates to the connecting passage 75, via the passage 73.

A flexible film 78 is attached to the upper surface of the main body 60 such that the flexible film 78 lies over the upper damper chamber 71 and passages formed in the main body 60. A flexible film 79 is attached to the lower surface of the main body 60 such that the flexible film 79 lies under the lower damper chamber 71 and passages formed in the main body 60. Each of the damper chambers 71 has a generally same depth as the passages 72 and 73, but has a significantly greater width than the passages 72 and 73. This configuration provides a wider portion with a greater volumetric capacity to the supply passage 62. The consumption of ink by the head body 13 may cause pressure of ink in the head body 13 to decrease, thereby causing ink in the ink cartridges 42 to flow into the supply passages 62 in the sub-tank 14. Without the damper chambers 71, significant pressure fluctuation of ink in the supply passages 62 might have caused the head body 13 to eject ink with an adverse effect. According to the present disclosure, the pressure fluctuations arising in ink in the supply passages 62 may be reduced in the damper chambers 71 with greater volumetric capacities, which are provided in the supply passages 62 and are covered by the flexible films 78 and 79.

As depicted in FIG. 4, the main body 60 has groove-shaped four air paths 74, each connected to a respective one of the connecting passages 75. Each of the air paths 74 extends to a respective one of vents 23 provided at a right portion of the sub-tank 14. Each of the four vents 23 includes a valve (not depicted) disposed therein. The valve allows and prevents air flow through the air path 74 to an exterior of the head 5. In FIG. 4, one air path 74 formed on the upper surface of the main body 60 is illustrated in detail while other three air paths 74 are not.

For the purpose of description, a fluid passage from a portion of the flexible tube 22 connected to its corresponding ink cartridge 42, to the nozzles 46 may be hereinafter referred to as the "entire ink passage 85," as depicted in FIG. 1.

Referring to FIG. 1, the feed roller 7 and the discharge roller 8 are configured to be driven by a conveying motor 29 (refer to FIG. 2) in sync with each other. The feed roller 7 and the discharge roller 8 cooperate with each other to convey a sheet P on the platen 2 in a sheet conveying direction, as depicted in FIG. 1.

The controller 100 of the printer 1 controls the feed roller 7 and the discharge roller 8 to convey a sheet P in the sheet conveying direction, and the head 5, which is mounted on the carriage 3, to move in the scanning direction and eject ink onto the sheet P. Thus, the printer 1 prints a desired image and/or text on the sheet P. The printer 1 may be, but not limited to, a serial printer.

The maintenance unit 9 is configured to perform maintenance or servicing operations for the head 5, thereby maintaining proper ejection performances or otherwise recovering ejection performances. The maintenance unit 9 includes a cap unit 50, a suction pump 51, a switching device 52, and a waste ink tank 53.

The cap unit 50 is located to one side (e.g., the right side in FIG. 1) of the platen 2 in the scanning direction. The carriage 3 moved to the right of the platen 2, may face the cap unit 50 in the top-bottom direction. The cap unit 50 is configured to be driven by a cap drive motor 24 (refer to FIG. 2) to move up and down. The cap unit 50 includes a nozzle cap 55, and a vent cap 56, each configured to contact the head 5. The nozzle cap 55 is formed of, for example, rubber. The nozzle cap 55 includes a cap 55*a* for black ink (black ink cap 55*a*) and a cap 55*b* for color inks other than black (color ink cap 55*b*).

When the carriage 3 faces the cap unit 50, the nozzle cap 55 faces the lower end of the head body 13 and the vent cap 56 faces a lower end of the right portion of the sub-tank 14 defining the four vents 23. The cap unit 50 facing the carriage 3 may be moved upward to attach to the head body 13 and the sub-tank 14. The black ink cap 55*a* covers all the nozzles 46 of the nozzle array 47K. The color ink cap 55*b* covers all the nozzles 46 of the three nozzle arrays 47Y, 47M, and 47C. At this time, the vent cap 56 covers to the four vents 23. The vent cap 56 includes four rod members 27, each configured to open and close a corresponding one of the valves located in the four vents 23. With the vent cap 56 covering the four vents 23, the four rod members 27 may be moved in the vertical direction by a vent motor 28 (refer to FIG. 2). Each of the rod members 27 entered into a corresponding one of the vents 23 from below may drive or move the valve in the vent 23.

An inlet of the suction pump 51 is connected, via the switching device 52, to the black ink cap 55*a* and the color ink cap 55*b* of the nozzle cap 55, and the vent cap 56. The switching device 52 is configured to allow any one of the black ink cap 55*a*, the color ink cap 55*b*, and the vent cap 56 to be selectively connected to the suction pump 51. An outlet of the suction pump 51 is connected to the waste ink tank 53.

The controller 100 of the printer 1 controls the maintenance unit 9 to perform maintenance or servicing operations, e.g., a suctioning purge operation and an air purge operation.

The suctioning purge operation may be performed to force a discharge of ink from the nozzles 46. To forcibly discharge black ink from the nozzles 46 of the nozzle array 47K in the suctioning purge operation, the nozzles 46 are first covered by the black ink cap 55*a*. With the nozzles 46 covered by the black ink cap 55*a*, the black ink cap 55*a* is brought into communication with the suction pump 51. The suction pump 51 is then driven. Driving the suction pump 51 may create negative pressure in a space between the black ink cap 55*a* and the nozzles 46, thereby discharging black ink from the nozzles 46 of the nozzle array 47K forcibly.

Similarly, the suctioning purge operation may be performed for color inks other than black to forcibly discharge the inks from the nozzles 46 of the nozzle arrays 47Y, 47M, and 47C. In the suctioning purge operation, the nozzles 46 of the nozzle arrays 47Y, 47M, and 47C are covered by the color ink cap 55*b*. With the nozzles 46 covered by the color ink cap 55*b*, the color ink cap 55*b* is brought into communication with the suction pump 51. The suction pump 51 is then driven, thereby discharging the color inks from the nozzles 46 of the nozzle arrays 47Y, 47M, and 47C forcibly in a similar manner that the black ink is discharged from the nozzles 46 of the nozzle array 47K.

In the illustrative embodiment, a nozzle maintenance purging operation, and a settled ink purge operation may be performed by suctioning or the suctioning purge operation. The nozzle maintenance purge operation may be performed to recover ejection performances of the nozzles 46, by discharging or removing, through the nozzles 46, foreign materials, air bubbles, and/or viscous ink, which may exist in the head 5. The nozzle maintenance purge operation may be performed automatically at a regular interval upon a lapse of a predetermined time period from the last printing operation, or performed manually based on a user's input or instruction provided via the user interface 90. As will be described in detail below, the settled ink purge operation may be performed for the ink cartridge 42 containing pigment ink because the pigment ink may have isolated viscosity locally in the ink cartridge 42. The viscous ink may be discharged through the nozzles 46 during the settled ink purge operation.

The air purge operation may be performed to vent, through the vents 23, air, e.g., air bubbles in the supply passages 62 of the sub-tank 14, before the air moves to the head body 13. The air purge operation may be performed, for example, prior to the nozzle maintenance purge operation. The air purge operation may be performed with the vent cap 56 covering the vents 23 and the valves in the vents 23 opened by the rod members 27. The switching device 52 brings the suction pump 51 into communication with the vent cap 56, and the suction pump 51 is then driven. Driving the suction pump 51 may create negative pressures in the vents 23, thereby venting air in the four supply passages 62 simultaneously through the vents 23.

The waste ink tank 53, which is connected to the suction pump 51, receives ink discharged from the head 5 by the suctioning purge operation or the air purge operation.

The user interface 90 allows various information to be input from and output to a user. As depicted in FIG. 2, the user interface 90 includes operation keys 90*a* and a display 90*b*. The operation keys 90*a* are configured to receive user inputs, and output data corresponding to the user inputs to the controller 100. The display 90*b* is configured to display various information under the control of the controller 100.

The temperature sensor 91 is located adjacent to the cartridge receiving portion 41. The temperature sensor 91 is configured to detect or measure a temperature of the ink cartridge 42 and output a signal corresponding to the detected temperature to the controller 100. The controller 100 is configured to generate temperature data based on the signal received from the temperature sensor 91. The temperature sensor 91 may detect or measure an actual temperature of the ink cartridge 42. Alternatively, the temperature sensor 91 may detect an ambient temperature of the ink cartridge 42 or an internal temperature of the inkjet printer 1. Based on the detected ambient temperature or the internal temperature, the controller 100 may estimate the temperature of the ink cartridge 42. In another embodiment, the controller 100 may generate a parameter that varies depending on the temperature detected by the temperature sensor 91. The parameter may be used as temperature data.

As depicted in FIG. 2, the controller 100 includes a central processing unit ("CPU") 101, a read only memory ("ROM") 102, a random access memory ("RAM") 103, a nonvolatile memory 104, control circuitry 105, and a bus 106. The ROM 102 stores various data and programs to be executed by the CPU 101. The nonvolatile memory 104 temporarily stores data (e.g., image data) required for executing the programs. The nonvolatile memory 104 includes a first area 104*a* for storing an amount of ink remaining in each of the ink cartridges 42 and a second area 104*b* for storing a total ejected amount of ink ejected from the nozzles 46 of each nozzle array 47Y, 47M, 47C, and 47K. The first area 104*a* may store numerals or parameters (e.g., characters) representing an amount of ink remaining in each of the ink cartridges 42 and total ejected amount of ink ejected from the nozzles 46 of each nozzle array 47Y, 47M, 47C, and 47K. The numeral representing the remaining amount of the ink may be determined by decrementing a number of ejected ink droplets and a number of droplets corresponding to the purged ink from a predetermined number of droplets corresponding to the initial ink quantity. The second area 104*b* may store numerals or parameters (e.g., characters) representing the accumulated number of ink droplets that has been ejected since the ink cartridge 42 was mounted to the cartridge receiving portions 41 or since the remaining ink amount stored in the second area 104*b* was reset to zero. The control circuitry 105 is connected to various units or devices of the printer 1, e.g., the head 5, the carriage drive motor 20, and the cap drive motor 24 for moving the cap unit 50 up and down, as well as an external device 31, e.g., a general-purpose computer.

In response to a print command transmitted from the external device 31, the CPU 101 generates, based on image data, ejection data representing an amount of ink to be ejected from the nozzles 46. Subsequently, the CPU 101 controls, for example, the head 5 and the carriage drive motor 20, to eject ink based on the ejection data from the nozzles 46 onto a sheet P, thereby printing an image on the sheet P. The CPU 101 controls, for example, the suction pump 51 and the switching device 52, to execute the suctioning purge operation and the air purge operation.

In the illustrative embodiment, the controller 100 is configured to execute processing by one CPU. In another embodiment, the controller 100 may be configured to execute processing by one or more CPUs, one or more application specific integrated circuit ("ASICs"), or a combination of one or more CPUs and one or more ASICs.

The pigment ink contained in the ink cartridge 42 has pigments dispersed in a solvent. Pigments that have relatively higher specific gravity may settle to the bottom or a lower end portion of the ink cartridge 42 during periods of storage or non-use. Such pigment settling may cause the ink at a lower end portion of the ink cartridge 42 to be locally concentrated or enriched and become viscous.

The ink cartridge 42K (containing black ink) tends to have more settled pigments and a greater viscosity than the other ink cartridges 42Y, 42M and 42C, because the black ink has pigment particles that are greater in diameter, weight, and quantity than those of the other color inks (e.g., yellow, magenta, and cyan). The black ink having an increased viscosity at a lower end portion of the ink cartridge 42K due to pigment settling may clog the nozzles 46 when supplied to the head 5.

In the illustrative embodiment, the CPU 101 controls the maintenance unit 9 to execute the settled ink purge operation, thereby discharging pigment ink, which may become viscous locally at a lower end portion of the ink cartridge 42, through the nozzles 46. As described above, pigments of the color inks are less likely to settle than those of the black ink. Accordingly, the settled ink purge operation, in which pigment ink is discharged through the nozzles 46, may be performed for the ink cartridge 42K but may not be performed for the ink cartridges 42Y, 42M, and 42C in the illustrative embodiment.

The settled ink purge operation is now described in detail below. As described above, ink contained in the ink chamber 44*a* and 44*b* of the ink cartridge 42 is supplied to the head 5, via the conduit 45 located at a lower portion of the ink chamber 44*a* and 44*b*. As the ink is ejected through the nozzles 46 of the head 5, the same amount of ink as was ejected through the nozzles 46 may be supplied from a lower end portion of the ink cartridge 42 to the head 5.

In a case where the printer 1 has printed a relatively large number of sheets P and has ejected a relatively large amount of ink through the nozzles 46 (e.g., the total ejected amount of ink is greater) during a predetermined period of time, clogging of the nozzles 46 attributable to the pigment settling is unlikely to occur, because ink at a lower end portion of the ink cartridge 42 is supplied to the head 5, before the viscosity of ink passes a threshold level or value (e.g., 5 cps) that causes clogging of the nozzles 46.

Figure 6:
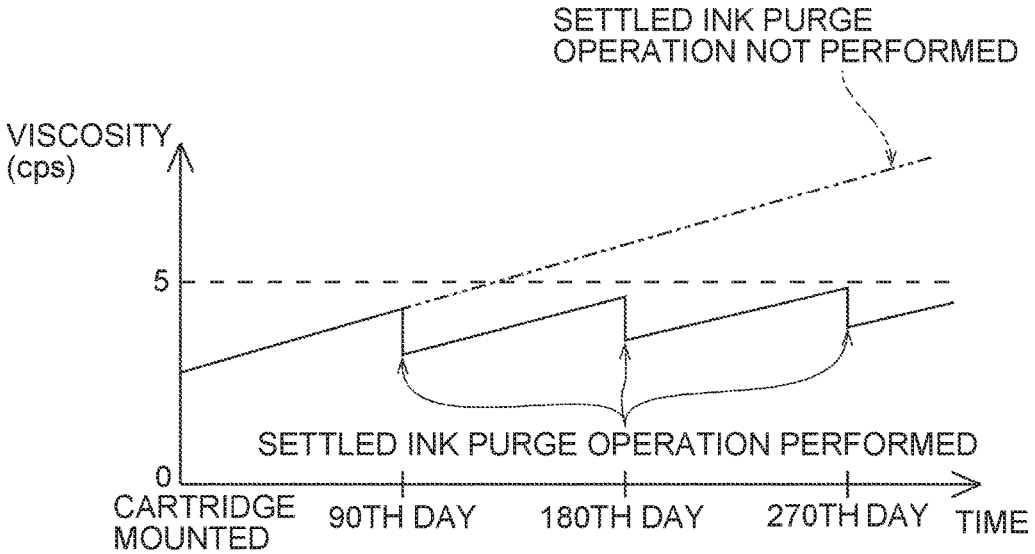
FIG. 6 is a graph depicting a relationship between viscosities of pigment ink near a lower end portion of an ink cartridge and elapsed times.

In contrast, in a case where the printer 1 has printed a relatively small number of sheets P and has ejected a relatively small amount of ink through the nozzles 46 (e.g., the total ejected amount of ink is smaller) during the predetermined period of time, the clogging of the nozzles 46 attributable to the pigment settling is likely to occur, because less ink is supplied from the ink cartridge 42 to the head 5 and the viscosity of ink at a lower end portion of the ink cartridge 42 may increase to the threshold that causes clogging of the nozzles 46 (see two-dot chain lines in FIG. 6).

As a solution to this problem, the CPU 101 controls the maintenance unit 9 to execute the settled ink purge operation in order to decrease the viscosity of pigment ink at a lower end portion of the ink cartridge 42, as depicted in FIG. 6. In the illustrative embodiment, the settled ink purge operation may be performed to prevent the viscosity of pigment ink at a lower end portion of the ink cartridge 42 from increasing to such a level that causes clogging of the nozzles 46, when the total amount of ink ejected from the nozzles 46 during a predetermined period of time (e.g., 90 days) is small.

For the settled ink purge operation, the CPU 101 calculates or determines an amount of ink ejected (e.g., an ink ejected amount) every time printing or the nozzle maintenance purge operation is performed. The CPU 101 adds the determined amount to the total ink ejected amount stored in the second area 104*b*. For printing, the CPU 101 determines an amount of ink ejected from the nozzles 46, for example, based on ejection data used for printing. For the nozzle maintenance purge operation, the CPU 101 determines an amount of ink ejected or discharged from the nozzles 46, for example, based on the suctioning force of the suction pump 51 (e.g., a rotational speed and a driving time). The ink ejected amount stored in the second area 104*b* is reset to zero every time the CPU 101 executes a particular step (e.g., S9), as will be described in detail below.

Once an ink cartridge 42 is mounted to its corresponding cartridge receiving portion 41, the CPU 101 refers, in the particular step, to the second area 104*b* to determine whether the total ejected amount of ink ejected from the nozzles 46 in 90 days is less than a predetermined reference amount.

The reference amount is pre-determined based on experiments. The reference amount is a minimum amount of ink required to be ejected/discharged in the first 90 days to prevent the nozzles 46 from being clogged when printing is performed on the 90th day. In the illustrative embodiment, the reference amount is fixed or invariable, and prestored in the nonvolatile memory 104. The same reference amount may be used every time (e.g., on 90th day and 180th day) the CPU 101 determines whether the total amount of ink ejected in 90 days is less than the reference amount.

If the CPU 101 determines that the total amount of ink ejected in 90 days is less than the reference amount, the CPU 101 determines the settled ink purge operation is to be executed, and determines an amount of ink to be discharged (e.g., ink discharge amount) by the settled ink purge operation. As will be described in detail below, to determine an ink discharge amount in the settled ink purge operation, an amount of ink remaining in the ink cartridge 42, the temperature data, and the quantity data may be used, in addition to the total ink ejected amount and the reference amount. Subsequently, the CPU 101 controls the maintenance unit 9 to execute the settled ink purge operation in which the determined amount of ink may be discharged through the nozzles 46.

As the total amount of ink ejected from the nozzles 46 in 90 days is smaller, the ink cartridge 42 is likely to have a greater amount of settled pigments and have much viscous ink at a lower end thereof. The CPU 101 determines that a greater amount of ink is to be discharged through the nozzles 46 in the settled ink purge operation as the total amount of ink ejected in 90 days is smaller. This configuration allows the settled ink purge operation to discharge an appropriate amount of ink through the nozzles 46 according to an amount of pigments settling in the ink cartridge 42.

The inventor of the disclosure has found that a relatively greater amount of ink remaining in the ink cartridge 42 has a relatively greater amount of pigment particles present in the ink, which will result in a relatively greater amount of pigments settling in the ink cartridge 42 during a particular period of time.

The ink discharge amount may be obtained by subtracting the total ink ejected amount from the reference amount. Discharging the thus obtained ink discharge amount in the settled ink purge operation may result in excessive or insufficient ink discharge according to an amount of ink remaining in the ink cartridge 42. The insufficient discharge of viscous ink may result in nozzle clogging.

In the illustrative embodiment, prior to determining an ink discharge amount in the settled ink purge operation, the CPU 101 determines an amount of ink remaining in the ink cartridge 42 by referring to the first area 104*a*. Subsequently, the CPU 101 may determine an ink discharge amount in the settled ink purge operation, based on the determined amount of ink remaining in the ink cartridge 42. As the amount of ink remaining in the ink cartridge 42 is greater, an amount of ink to be discharged from the nozzles 46 in the settled ink purge operation is greater.

To determine an appropriate or desired amount of ink to be discharged in the settled ink purge operation, the CPU 101 determines an adjustment value that adjusts an ink discharge amount or a difference obtained by subtracting the total ink ejected amount from the reference amount. The CPU 101 determines a greater adjustment value for a greater amount of ink remaining in the ink cartridge 42. The adjustment value may be derived from, for example, experiments or computer simulations. The CPU 101 determines an appropriate ink discharge amount by multiplying the difference by the adjustment value. If an amount of the ink remaining in the ink cartridge 42 is greater, a greater amount of ink may be discharged from the nozzles 46 in the settled ink purge operation. This may allow viscous ink at a lower end portion of the ink cartridge 42 to be discharged or purged efficiently, reducing excessive ink discharge.

As the ink cartridge 42 has a higher temperature, pigment ink in the ink cartridge 42 tends to have a lower viscosity, which promotes the pigment settling. In the illustrative embodiment, temperature data about the temperatures of the ink cartridge 42 detected by the temperature sensor 91 for 90 days is used for determining an adjustment value. In one example, based on the temperature data for 90 days (e.g., an average of temperatures of the ink cartridge 42 in 90 days), the CPU 101 determines an adjustment value, which is greater as the average of temperatures of the ink cartridge 42 in 90 days is greater. In another embodiment, the CPU 101 may determine an adjustment value, which may be greater as the temperature of the ink cartridge 42 that is most recently detected by the temperature sensor 91 is higher. Alternatively, the CPU 101 may determine an adjustment value, which may be greater as the peak temperature of the ink cartridge 42 in 90 days is higher.

As described above, the cartridge receiving portion 41 is configured to selectively receive two types of the ink cartridges 42 (e.g., the standard ink cartridge 42*a* and the high-yield ink cartridge 42*b*) with different initial ink quantities. The high-yield ink cartridge 42*b*, which contains much pigment ink, has more pigment particles than the standard ink cartridge 42*a*, and thus tends to have more settled pigments. The high-yield ink cartridge 42*b* has the generally same bottom area as the standard ink cartridge 42*a*, and thus tends to have ink with increased viscosity due to the pigment settling, present at a higher level than the standard ink cartridge 42*a*. In addition, the viscous ink due to the pigment settling has lower fluidity, and is likely to stay at a lower end portion of the ink cartridge 42. In a case where the high-yield ink cartridge 42*b* and the standard ink cartridge 42*a* each have the same amount of ink remaining therein, the high-yield ink cartridge 42*b* tends to have more pigment particles settling at a lower end portion thereof than the standard ink cartridge 42*a*, resulting in increased ink viscosity. In the illustrative embodiment, the CPU 101 uses the quantity data stored in the memory 142 of the ink cartridge 42, to determine an adjustment value. In one example, based on the quantity data, the CPU 101 determines an adjustment value, which is greater for an ink cartridge 42 having a greater amount of ink initially contained therein. In short, for the high-yield ink cartridge 42*b*, the CPU 101 determines an adjustment value, which is greater than that for the standard ink cartridge 42*a*.

As described above, the CPU 101 determines an adjustment value, based on the amount of ink remaining in the ink cartridge 42, the quantity data, and the temperature data. In the illustrative embodiment, to facilitate the determination of an adjustment value, the ROM 102 may prestore adjustment value tables for the standard ink cartridge 42*a*, as depicted in FIG. 7A, and for the high-yield ink cartridge 42*b*, as depicted in FIG. 7B. The CPU 101 refers to an adjustment value table to determine an adjustment value.

In the illustrative embodiment, the adjustment value table specifies an adjustment value for each combination of an amount of ink remaining in the ink cartridge 42, which is classified with two threshold values into "LARGE", "MEDIUM", and "SMALL", and a temperature of the ink cartridge 42, which is classified with one threshold value into "HIGH" and "LOW". In one same temperature category ("HIGH" or "LOW") as depicted in FIGS. 7A and 7B, each adjustment value table specifies a greater adjustment value for a greater remaining ink amount. For example, in a case where the temperature of the standard ink cartridge 42*a* falls within a category of "HIGH", the adjustment value table depicted in FIG. 7A, specifies a greatest adjustment value "a" for "LARGE" amount of ink remaining; a greater adjustment value "b" for "MEDIUM" amount of ink remaining; and a smallest adjustment value "c" for "SMALL" amount of ink remaining ("a">"b">"c"). Further, in one same remaining ink category ("LARGE", "MEDIUM", or "SMALL"), each adjustment value table specifies a greater adjustment value for a higher temperature. For example, in a case where an amount of ink remaining in the standard ink cartridge 42*a* falls within a category of "LARGE," the adjustment value table depicted in FIG. 7A specifies the adjustment value "a" for "HIGH" temperature, which is greater than an adjustment value "d" for "LOW" temperature.

If the temperature of each ink cartridge 42*a* and 42*b* falls within the same temperature category and the amount of ink remaining in each ink cartridge 42*a* and 42*b* falls within the same remaining ink category, an adjustment value for the high-yield ink cartridge 42*b* is greater than that for the standard ink cartridge 42*a*. For example, in a case where the amount of ink remaining in each ink cartridge 42*a* and 42*b* falls within "LARGE", and the temperature of each ink cartridge 42*a* and 42*b* falls within "HIGH," an adjustment value "A" for the high-yield ink cartridge 42*b* is greater than the adjustment value "a" for the standard ink cartridge 42*a*.

As described above, the CPU 101 refers to the adjustment value table stored in the ROM 102, to determine an adjustment value based on the amount of ink remaining in the ink cartridge 42, and the capacity and temperature data of the ink cartridge 42. This may allow an appropriate amount of ink to be discharged in the settled ink purge operation. In another embodiment, the ROM 102 may store a calculation formula or a mathematical expression for determining an adjustment value based on a remaining ink amount, the quantity data, and the temperature data. The CPU 101 may determine an adjustment value using the calculation formula.

(Operations of Inkjet Printer)

Figure 8:
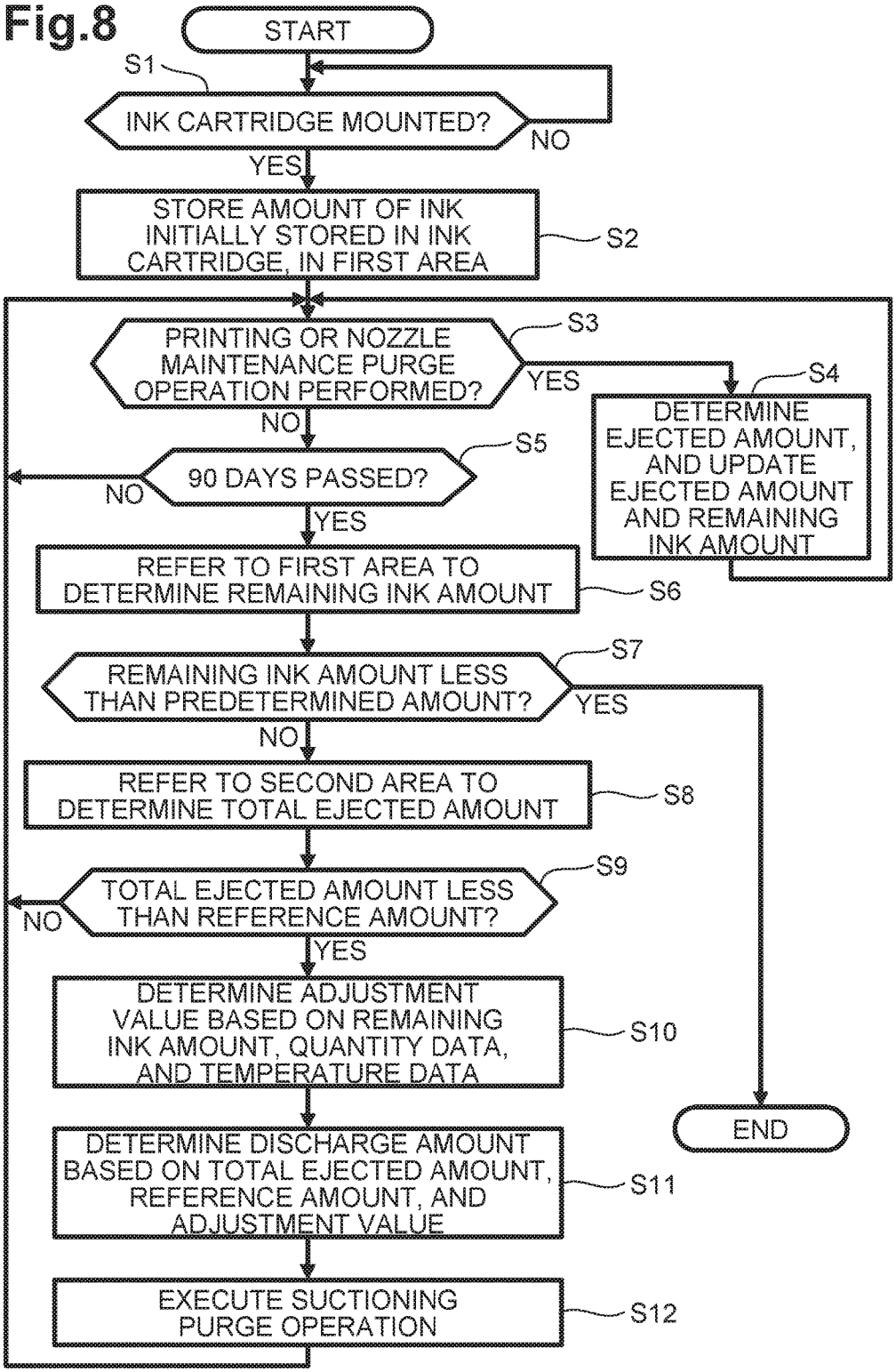
FIG. 8 is a flowchart depicting processes that are executed by the inkjet printer in a first illustrative embodiment according to one or more aspects of the disclosure.

Next, processes for the settled ink purge operation to be executed by the printer 1 are described referring to FIG. 8

If the CPU 101 determines, based on a signal from the cartridge detecting sensor 152, that an ink cartridge 42 is mounted on the cartridge receiving portion 41 (e.g., for replacement) (S1: YES), the CPU 101 receives the quantity data stored in the memory 142 of the ink cartridge 42. Based on the quantity data, the CPU 101 stores an amount of ink initially stored in the ink cartridge 42, as "a remaining ink amount" in the first area 104*a* of the nonvolatile memory 104 (S2). At this time, the CPU 101 resets the total ink ejected amount stored in the second area 104*b* of the nonvolatile memory 104 to zero.

Subsequently, the CPU 101 determines whether ink is ejected or discharged from the nozzles 46 for printing onto a sheet P or the nozzle maintenance purge operation (S3). The CPU 101 determines that ink is ejected or discharged from the nozzles 46 (S3: YES), the CPU 101 calculates or determines an amount of ink ejected or discharged from the nozzles 46, and adds the calculated amount to the total ink ejected amount stored in the second area 104*b* (S4). At this time, the CPU 101 updates the remaining ink amount stored in the first area 104*a*, by subtracting an amount of ink ejected or discharged from the nozzles 46, from the remaining ink amount stored in the first area 104*a*. Subsequent to S4, flow returns to S3.

If the CPU 101 determines that ink is not ejected or discharged from the nozzles 46 (S3: NO), the CPU 101 determines whether 90 days have passed from the mounting date at which the ink cartridge 42 is mounted to the cartridge receiving portion 41 or the last executing date at which a particular step (e.g., S9), as will be described in detail below, was executed last (S5). If the CPU 101 determines that 90 days has not yet passed from the mounting date or the executing date (S5: NO), flow returns to S3.

If the CPU 101 determines that 90 days has passed from the mounting date or the executing date (S5: YES), the CPU 101 refers to the first area 104*a* to determine an amount of ink remaining in the ink cartridge 42 (S6). Subsequently, the CPU 101 determines whether the remaining ink amount determined at S6 is less than a predetermined amount (S7). The predetermined amount is a minimum amount of pigment ink that causes clogging of the nozzles 46 due to pigment settling after being unused for an extended period of time.

If the CPU 101 determines that the remaining ink amount determined at S6 is less than the predetermined amount (S7: YES), the CPU 101 determines that the settled ink purge operation is not to be executed, and flow ends. If the CPU 101 determines that the remaining ink amount determined at S6 is greater than or equal to the predetermined amount (S7: NO), the CPU 101 refers to the second area 104*b* to determine the total amount of ink ejected or discharged from the nozzles 46 in 90 days (S8). The CPU 101 determines whether the total ink ejected amount stored in the nonvolatile memory 104 is less than the reference amount (S9). If the CPU 101 determines that the total ink ejected amount is greater than or equal to the reference amount (S9: NO), the CPU 101 determines that the settled ink purge operation is not to be executed, and resets the total ink ejected amount stored in the second area 104*b* to zero. Subsequently, the flow returns to step S3.

At step S9, if the CPU 101 determines that the total ink ejected amount is less than the reference amount (S9: YES), the CPU 101 determines that the settled ink purge operation is to be executed. The CPU 101 determines an adjustment value, based on the quantity data stored in the memory 142 of the ink cartridge 42, the temperature data, and the remaining ink amount determined at S6 (S10). Subsequently, the CPU 101 determines an amount of ink to be discharged in the settled ink purge operation (S11), by multiplying the adjustment value determined at S10 by the difference obtained by subtracting the total ink ejected amount determined at S8 from the reference amount stored in the nonvolatile memory 104.

Subsequently, the CPU 101 controls the maintenance unit 9 to execute the settled ink purge operation in which an amount of ink determined at S11 is discharged from the nozzles 46 (S12). In one example, the CPU 101 controls the maintenance unit 9 to cover or cap the nozzles 46 with the nozzle cap 55 and drive the suction pump 51 after the black ink cap 55*a* is brought into communication with the suction pump 51. Subsequently, the CPU 101 controls the suction pump 51 (e.g., the rotational speed and the drive time), to cause the amount of ink determined at S11 to be discharged from the nozzles 46. Subsequent to S12, flow returns to S3.

In the illustrative embodiment, as a greater amount of ink remains in the ink cartridge 42, a greater amount of ink may be discharged through the nozzles 46 in the settled ink purge operation. This may reduce such possibilities that concentrated or viscous pigment ink remains in the ink cartridge 42, as well as reduce ink from being unnecessarily discharged in the settled ink purge operation.

The settled ink purge operation may reduce such possibilities that viscous ink remains in the ink cartridge 42, because the settled ink purge operation is executed for the head 5 that has ejected a relatively small amount of ink in 90 days from the mounting date at which the ink cartridge 42 is mounted to the cartridge receiving portions 41, or the last executing date at which the CPU 101 last determined whether the total ink ejected amount stored in the nonvolatile memory 104 is less than the reference amount.

In the illustrative embodiment, if the CPU 101 determines that an amount of ink remaining in the ink cartridge 42 is less than the predetermined amount, the settled ink purge operation may not be performed because the ink cartridge 42 may have less pigments. This configuration may extend a life of the ink cartridge 42 or extend a time period before ink in the ink cartridge 42 is depleted.

In the illustrative embodiment, the settled ink purge operation for discharging ink in the ink cartridge 42 through the nozzles 46, is executed for the ink cartridge 42K that contains black pigment ink, but not executed for the ink cartridges 42Y, 42C and 42M that contain color (e.g., yellow, cyan, and magenta) inks having pigments that are less likely to settle. This configuration may prevent or reduce the color inks from being unnecessarily discharged from the ink cartridges 42Y, 42C and 42M.

In addition, the conduit 45, to which the supply tube 41*a* of the cartridge receiving portion 41 is connected, is located at a lower portion of the ink chamber 44*a* or 44*b* of the ink cartridge 42. This configuration may allow viscous ink at a lower portion of the ink chamber 44*a* and 44*b* to be effectively discharged from the nozzles 46 via the conduit 45 in the settled ink purge operation.

Second Illustrative Embodiment

A second illustrative embodiment of the disclosure is now described. Like numerals in the drawings denote like components and the detailed description of those components described above is omitted. A significant difference between the first and second illustrative embodiments is that a reference amount. In the second illustrative embodiment, a reference amount is variable and the CPU 101 determines a reference amount prior to another particular step (e.g., A10 in FIG. 10), based on an amount of ink remaining in the ink cartridge 42, and temperature and quantity data of the ink cartridge 42.

In one example, the CPU 101 sets a greater reference amount for a greater amount of ink remaining in the ink cartridge 42.

As described above, as the temperature of the ink cartridge 42 is higher, more pigments may settle. The CPU 101 sets or determines a reference amount, which is greater as the average of temperatures of the ink cartridge 42 detected by the temperature sensor 91 in 90 days, is greater. In another embodiment, the CPU 101 may set or determine a reference amount, which may be greater as the temperature of the ink cartridge 42 that is most recently detected by the temperature sensor 91 is higher. Alternatively, the CPU 101 may determine a reference amount, which may be greater as the peak temperature of the ink cartridge 42 in 90 days is higher.

As described above, the high-yield ink cartridge 42*b* is likely to have more viscous ink at a lower end portion thereof than the standard ink cartridge 42*a*. The CPU 101 sets a reference amount, which is greater as the capacity of the ink cartridge 42 is determined to be greater, based on the quantity data stored in the memory 142. In another embodiment, an ink cartridge may initially store less ink than the standard ink cartridge 42*a*. The viscosity of ink at a lower end portion of such ink cartridge may not increase to such a level that causes clogging of the nozzles 46 during periods of storage or non-use. In this case, the CPU 101 may set a reference amount to zero to prevent the settled ink purge operation from being executed.

The CPU 101 sets or determines a reference amount based on an amount of ink remaining in the ink cartridge 42, and capacity and temperature data of the ink cartridge 42. In the illustrative embodiment, to facilitate the determination of a reference amount, the ROM 102 prestores reference amount tables for the standard ink cartridge 42*a*, as depicted in FIG. 9A, and for the high-yield ink cartridge 42*b*, as depicted in FIG. 9B. The CPU 101 refers to a reference amount table to set or determine a reference amount.

The reference amount table specifies a reference amount for each combination of an amount of ink remaining in the ink cartridge 42 ("LARGE", "MEDIUM", and "SMALL") and a temperature of the ink cartridge 42 ("HIGH" and "LOW"). In one same temperature category ("HIGH" or "LOW") as depicted in FIGS. 9A and 9B, each reference amount table specifies a greater reference amount for a greater remaining ink amount. For example, in a case where the temperature of the standard ink cartridge 42*a* falls within a category of "HIGH", the reference amount table as depicted in FIG. 9A, specifies a greatest reference amount "u" for a "LARGE" amount of ink remaining; a greater reference amount "v" for a "MEDIUM" amount of ink remaining; and a smallest reference amount "w" for a "SMALL" amount of ink remaining ("u">"v">"w"). Further, in one same remaining ink category ("LARGE", "MEDIUM", or "SMALL"), each reference amount table specifies a greater reference amount for a higher temperature. For example, in a case where an amount of ink remaining in the standard ink cartridge 42*a* falls within a category of "LARGE," the reference amount table as depicted in FIG. 9A, specifies the reference amount "u" for a "HIGH" temperature, which is greater than a reference amount "x" for a "LOW" temperature.

If the temperature of each ink cartridge 42*a* and 42*b* falls within the same temperature category and the amount of ink remaining in each ink cartridge 42*a* and 42*b* falls within the same remaining ink category, a reference amount for the high-yield ink cartridge 42*b* is greater than that for the standard ink cartridge 42*a*. For example, in a case where the amount of ink remaining in each ink cartridge 42*a* and 42*b* falls within "LARGE", and the temperature of each ink cartridge 42*a* and 42*b* falls within "HIGH," a reference amount "U" for the high-yield ink cartridge 42*b* is greater than the reference amount "u" for the standard ink cartridge 42*a*.

As described above, the CPU 101 refers to the reference amount table stored in the ROM 102, to determine a reference amount based on the amount of ink remaining in the ink cartridge 42, and the capacity and temperature data of the ink cartridge 42. In another embodiment, the ROM 102 may store calculation formula or a mathematical expression for determining a reference amount based on a remaining ink amount, the quantity data, and the temperature data. The CPU 101 may determine a reference amount using the calculation formula.

Similar to the first illustrative embodiment, the CPU 101 determines an amount of ink to be discharged from the nozzles 46 in the settled ink purge operation. If the total amount of ink ejected from the nozzles 46 in 90 days is smaller, the CPU 101 determines a greater ink discharge amount. More specifically, in the second illustrative embodiment, the CPU 101 determines an ink discharge amount, by subtracting the total ink ejected amount stored in the second area 104*b*, from the reference amount determined as described above. This configuration allows the settled ink purge operation to discharge an appropriate amount of ink through the nozzles 46 according to an amount of pigments settling in the ink cartridge 42.

(Operations of Inkjet Printer)

Figure 10:
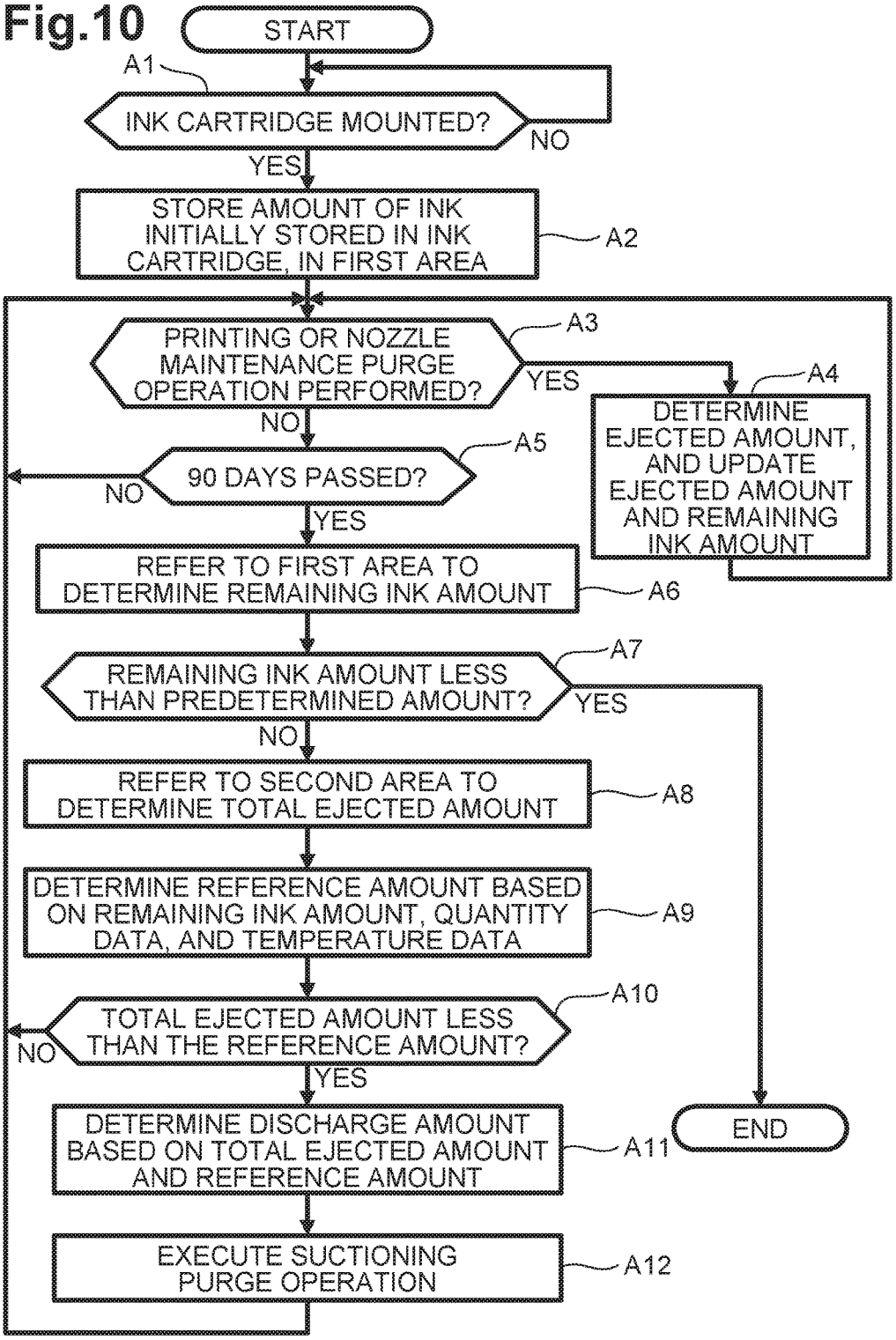
FIG. 10 is a flowchart depicting processes that are executed by the inkjet printer in a second illustrative embodiment according to one or more aspects of the disclosure.

Next, processes of the settled ink purge operation to be executed by the printer 1 according to the second illustrative embodiment are described referring to FIG. 10.

The CPU 101 executes A1-A8, similar to S1-S8 in FIG. 8. Subsequent to A8, the CPU 101 determines a reference amount based on a remaining ink amount, quantity data, and temperature data (A9). Subsequently, the CPU 101 determines whether the total ink ejected amount determined at A8 is less than the reference amount determined in A9 (A10). If the CPU 101 determines that the total ink ejected amount is greater than or equal to the reference amount (A10: NO), the CPU 101 determines that the settled ink purge operation is not to be executed and resets the total ink ejected amount stored in the second area 104*b* to zero. Subsequently, flow returns to A3.

If the CPU 101 determines, in A10, that the total ink ejected amount is less than the reference amount (A10: YES), the CPU 101 determines that the settled ink purge operation is to be executed. The CPU 101 determines an amount of ink to be discharged in the settled ink purge operation by subtracting the total ink ejected amount determined in A8 from the reference amount determined in A9 (A11). Subsequently, the CPU 101 controls the maintenance unit 9 to execute the settled ink purge operation in which an amount of ink determined in A11 is discharged from the nozzles 46 (A12).

The second illustrative embodiment may reliably reduce such possibilities that concentrated or viscous pigment ink from staying or remaining in the ink cartridge 42.

In the illustrative embodiment, the ink cartridge 42 is an example of "a tank." The maintenance unit 9 is an example of "a purge mechanism." The nozzle 46 of the nozzle array 47K is an example of a "first nozzle" and the nozzle 46 of the nozzle arrays 47Y, 47M, and 47C is an example of a "second nozzle." The black pigment ink is an example of "a first pigment ink" and the ink cartridge 42K containing black pigment ink is an example of "a first tank." A color pigment ink (excluding black ink) is an example of "a second pigment ink" and the ink cartridge 42 containing a color pigment ink is an example of "a second the tank." The conduit 45 is an example of "a fluid outlet."

While aspects are described in detail with reference to specific embodiments thereof, this is merely an example, and various changes, arrangements and modifications may be made therein without departing from the spirit and scope of the disclosure. For example, aspects described in the illustrative embodiments may be combined or partially changed within a scope of the disclosure. For example, in the first illustrative embodiment, a reference amount may be determined based on temperature data or quantity data. For example, based on the temperature data on the temperatures of the ink cartridge 42 detected for 90 days by the temperature sensor 91, a greater reference amount may be set for the ink cartridge 42 having a detection result of a higher temperature (e.g., a higher average temperature). Alternatively, based on the quantity data stored in the memory 142 of the ink cartridge 42, a greater reference amount may be set for the ink cartridge 42 that initially stores a greater amount of ink.

In the second illustrative embodiment, the CPU 101 may determine an ink discharge amount, similar to the first illustrative embodiment, by multiplying an adjustment value by a difference obtained by subtracting a total ink ejected amount from a reference amount. A greater adjustment value may be multiplied as a greater amount of ink remains in the ink cartridge 42. Based on temperature data on the temperatures of the ink cartridge 42 detected for 90 days by the temperature sensor 91, a greater adjustment value may be used for the ink cartridge 42 having a detection result of a higher temperature (e.g., a higher average temperature). Alternatively, a greater adjustment value may be used for the ink cartridge 42 that initially stores a greater amount of ink.

The CPU 101 may determine an amount of ink to be discharged in the settled ink purge operation, without using a reference amount and a total ink ejected amount.

For the maintenance purge operation, the CPU 101 may control the maintenance unit 9, similar to the settled ink purge operation, to discharge a greater amount of ink from the nozzles 46 as a greater amount of ink remains in the ink cartridge 42.

An ink discharge amount and a suctioning force of the suction pump 51 may be appropriately set for the settled ink purge operation with the aim of recovering ejection performances of the nozzles 46 as well.

The ink cartridge 42 with a remaining ink amount less than a predetermined amount may be subjected to the settled ink purge operation, unlike the illustrative embodiments. If the CPU 101 determines an amount of ink remaining in the ink cartridge 42 is less than or equal to an ink discharge amount, the settled ink purge operation may not be executed to prevent all ink in the ink cartridge 42 from being discharged by the settled ink purge operation, resulting in the empty ink cartridge 42. In this configuration, the user interface 90 may preferably display or indicate a message encouraging a user to replace the ink cartridge 42.

In another embodiment, the printer 1 may include a sensor configured to detect an amount of ink currently stored in the ink cartridge 42. Based on a signal from the sensor, the CPU 101 may determine an amount of ink remaining in the ink cartridge 42. In this configuration, the memory 142 of the ink cartridge 42 may store quantity data representing the ink cartridge 42 is either one of the standard ink cartridge 42*a* and the high-yield ink cartridge 42*b*. In yet another embodiment, the CPU 101 may estimate an amount of ink remaining in the ink cartridge 42, based on the number of days elapsed from the mounting date at which the ink cartridge 42 is mounted to the cartridge receiving portions 41. In still another embodiment, the CPU 101 may determine, at any time, whether the total amount of ink ejected from the nozzles 46 in 90 days is less than a reference amount.

The nozzle cap of the cap unit 50 may be configured to cover the nozzles 46 of the all nozzle arrays 47K, 47Y, 47M, and 47C. In this configuration, ink may be discharged through the nozzles 46 of all the nozzle arrays 47K, 47Y, 47M, and 47C at one time during the suctioning purge operation.

Further, the cartridge receiving portion 41 may be configured to selectively receive more than two types of ink cartridges 42, each having a different quantity of ink. The standard ink cartridge 42*a* and the high-yield ink cartridge 42*b*, each have generally the same bottom area and are configured to be selectively mounted to a cartridge receiving portion 41. In another embodiment, the standard ink cartridge 42*a* and the high-yield ink cartridge 42*b* may have different bottom areas. In this configuration also, the high-yield ink cartridge 42*b* has a greater amount of pigments that may settle at a lower end portion of the high-yield ink cartridge 42*b* than the standard ink cartridge 42*a*. In a case where ink cartridges 42 with different bottom areas have the same quantity of ink, an ink cartridge 42 having a smaller bottom area is likely to have viscous or concentrated ink due to pigment settling to a higher level.

The disclosure may be applied to a printer of an on-carriage type in which a cartridge receiving portion configured to receive an ink carriage is provided on a carriage. The conduit 45 of the ink cartridge 42 may not necessarily be connected to a lower portion of the ink chamber 44*a* and 44*b*, but may be connected to a middle portion of the ink chamber 44*a* and 44*b*.

In the above-described illustrative embodiments, pigment ink is discharged or suctioned through the nozzles 46 in the suctioning purge operation. In another embodiment, the pigment ink may be discharged through the nozzles 46 by applying positive pressures to ink in the ink cartridge 42, with a pump provided in the printer 1.

Further, in the illustrative embodiments, an ink supply source, e.g., a tank, is an ink cartridge. In another embodiment, an ink supply source may be, for example, a flexible ink-containing pouch made of resin. The pouch may have a cap to which the flexible tube 22 is connected. Connecting the flexible tube 22 to the cap may allow ink to flow out of the pouch through the flexible tube 22.

A tank that is fixed in the printer 1 may be connected to the entire ink passages 85. Ink may be supplied from the tank. When ink in the tank is depleted, a user may replenish ink by inserting a bottle containing ink into an opening formed in the tank.

The disclosure may be applied to a line-type inkjet printer in which an inkjet head fixed at a prescribed position, prints an image onto a sheet being conveyed by a conveying mechanism.

What is claimed is:

1. An inkjet printer comprising:

a head including a nozzle configured to eject pigment ink supplied from a tank during a print operation and during a purge operation;

a purge mechanism;

a tank receiving portion configured to removably receive the tank;

a tank detecting sensor; and a controller configured to:

determine whether to control the purge mechanism to perform the purge operation for discharging the pigment ink from the nozzle;

when determining to control the purge mechanism to perform the purge operation, determine a remaining amount of the pigment ink remaining in the tank;

determine a discharge amount to be discharged from the nozzle when performing the purge operation based on the remaining amount of the pigment ink remaining in the tank;

control the purge mechanism to perform the purge operation based on the discharge amount;

determine whether time elapsed from when the tank detecting sensor detects the tank mounted on the tank receiving portion passes a predetermined period;

when the elapsed time passes the predetermined period, determine a total ejected amount of the pigment ink ejected from the nozzle during the predetermined period;

determine whether the total ejected amount is less than a reference amount; and when the total ejected amount is less than the reference amount, control the purge mechanism to perform the purge operation, wherein, when the remaining amount is greater than or equal to a predetermined amount, the discharge amount is greater than the discharge amount when the remaining ink amount is less than the predetermined amount, wherein the reference amount is a minimum amount of the pigment ink required to be ejected during the predetermined period to prevent the nozzle from becoming clogged during the predetermined period, wherein the controller is configured to:

measure a second time elapsed from when the elapsed time passes the predetermined period;

determine whether the second time passes a second predetermined period;

when the second time passes the second predetermined period, determine a second total ejected amount of the pigment ink ejected from the nozzle during the second predetermined period and determine whether the second total ejected amount is less than a second reference amount; and when the second total ejected amount is less than the second reference amount, control the purge mechanism to perform the purge operation, wherein a length of the second predetermined period is equal to a length of the predetermined period, and wherein the reference amount is equal to the second reference amount.

2. An inkjet printer comprising:

a head including a nozzle configured to eject pigment ink supplied from a tank during a print operation and during a purge operation;

a purge mechanism;

a tank receiving portion configured to removably receive the tank;

a tank detecting sensor; and a controller configured to:

determine whether to control the purge mechanism to perform the purge operation for discharging the pigment ink from the nozzle;

when determining to control the purge mechanism to perform the purge operation, determine a remaining amount of the pigment ink remaining in the tank;

determine a discharge amount to be discharged from the nozzle when performing the purge operation based on the remaining amount of the pigment ink remaining in the tank;

control the purge mechanism to perform the purge operation based on the discharge amount;

determine whether time elapsed from when the tank detecting sensor detects the tank mounted on the tank receiving portion passes a predetermined period;

when the elapsed time passes the predetermined period, determine a total ejected amount of the pigment ink ejected from the nozzle during the predetermined period;

determine whether the total ejected amount is less than a reference amount; and when the total ejected amount is less than the reference amount, control the purge mechanism to perform the purge operation, wherein, when the remaining amount is greater than or equal to a predetermined amount, the discharge amount is greater than the discharge amount when the remaining ink amount is less than the predetermined amount, wherein the controller is configured to:

acquire a subtraction amount which represents a subtraction of the total ejected amount from the reference amount;

determine whether the subtraction amount is greater than or equal to a threshold subtraction amount; and determine the discharge amount based on the subtraction amount, and wherein the discharge amount is greater when the subtraction amount is greater than or equal to the threshold subtraction amount than when the subtraction amount is less than the threshold subtraction amount.

3. The inkjet printer according to claim 2, wherein the controller is configured to:

determine a correction amount based on the remaining amount of the pigment ink remaining in the tank; and determine the discharge amount by multiplying the subtraction amount by the correction amount, and wherein the correction amount is greater when the remaining amount is greater than or equal to the predetermined amount than when the remaining amount is less than the predetermined amount.

4. An inkjet printer comprising:

a head including a nozzle configured to eject pigment ink supplied from a tank during a print operation and during a purge operation;

a purge mechanism;

a tank receiving portion configured to removably receive the tank;

a tank detecting sensor; and a controller configured to:

determine whether to control the purge mechanism to perform the purge operation for discharging the pigment ink from the nozzle;

when determining to control the purge mechanism to perform the purge operation, determine a remaining amount of the pigment ink remaining in the tank;

determine a discharge amount to be discharged from the nozzle when performing the purge operation based on the remaining amount of the pigment ink remaining in the tank;

control the purge mechanism to perform the purge operation based on the discharge amount;

determine whether time elapsed from when the tank detecting sensor detects the tank mounted on the tank receiving portion passes a predetermined period;

when the elapsed time passes the predetermined period, determine a total ejected amount of the pigment ink ejected from the nozzle during the predetermined period;

determine whether the total ejected amount is less than a reference amount; and when the total ejected amount is less than the reference amount, control the purge mechanism to perform the purge operation, wherein, when the remaining amount is greater than or equal to a predetermined amount, the discharge amount is greater than the discharge amount when the remaining ink amount is less than the predetermined amount, and wherein the controller is configured to control the purge mechanism to perform the purge operation when the measured time elapsed from a time when the tank detecting sensor detects the tank mounted on the tank receiving portion passes a second predetermined time period, and the remaining amount is greater than or equal to a second predetermined amount that is less than the predetermined amount.

* * * * *